US010584492B2

(12) United States Patent
Chuang

(10) Patent No.: US 10,584,492 B2
(45) Date of Patent: Mar. 10, 2020

(54) DOUBLE WINDING REINFORCEMENT METHOD AND PRODUCT MADE BY THE SAME

(71) Applicant: Hsun-Jen Chuang, Taipei (TW)

(72) Inventor: Kuo-Jung Chuang, Taipei (TW)

(73) Assignee: Hsun-Jen Chuang, Taipei (TW)

( * ) Notice: Subject to any disclaimer, the term of this patent is extended or adjusted under 35 U.S.C. 154(b) by 0 days.

(21) Appl. No.: 16/218,200

(22) Filed: Dec. 12, 2018

(65) Prior Publication Data

US 2019/0203472 A1 Jul. 4, 2019

(30) Foreign Application Priority Data

Jan. 3, 2018 (TW) ..... 107100206 A

(51) Int. Cl.
*E04C 5/16* (2006.01)
*E04C 5/06* (2006.01)

(52) U.S. Cl.
CPC ..... *E04C 5/166* (2013.01); *E04C 5/0622* (2013.01)

(58) Field of Classification Search
CPC ..... E04C 3/34; E04C 5/166; E04C 5/0604; E04C 5/0622; E04C 5/0618; E04C 5/0636; E04C 5/06
See application file for complete search history.

(56) References Cited

U.S. PATENT DOCUMENTS

| | | | | |
|---|---|---|---|---|
| 3,722,164 A * | 3/1973 | Schmidgall | E04C 5/167 52/684 | |
| 4,999,965 A * | 3/1991 | Schmidgall | E04C 5/064 52/649.8 | |
| 2009/0178356 A1 * | 7/2009 | Baumann | E04C 3/34 52/414 | |

FOREIGN PATENT DOCUMENTS

| | | | | |
|---|---|---|---|---|
| CN | 102359230 A | 2/2012 | | |
| CN | 206722221 U | 12/2017 | | |
| DE | 2028409 A1 * | 12/1971 | B28B 13/0215 | |
| EP | 2735664 A1 | 5/2014 | | |
| TW | M489895 U | 11/2014 | | |
| TW | M492932 U | 1/2015 | | |
| TW | M538963 U | 4/2017 | | |
| TW | M562321 U | 6/2018 | | |
| WO | WO-2013150668 A1 * | 10/2013 | E04C 5/03 | |
| WO | WO-2015088297 A1 * | 6/2015 | E04C 3/34 | |
| WO | WO-2015147415 A1 * | 10/2015 | E04C 5/0604 | |
| WO | WO-2015194695 A1 * | 12/2015 | E04C 2/56 | |

* cited by examiner

*Primary Examiner* — Christine T Cajilig

(74) *Attorney, Agent, or Firm* — Pai Patent & Trademark Law Firm; Chao-Chang David Pai

(57) ABSTRACT

A double winding reinforcement method has a main bars erecting step, a reinforcement stirrup winding step, and a reinforcement bar double ends winding step. In the main bars erecting step, multiple main bars are vertically disposed and are arranged in a rectangular shape. In the reinforcement stirrup winding step, a reinforcement stirrup is horizontally wound around the multiple main bars and is wound in a rectangular shape, and the main bars are defined as multiple pairs of opposite main bars. In the reinforcement bar double ends winding step, each reinforcement bar has a first end and a second end. The first end of each reinforcement bar is fixed with one of the main bars of a respective one of the pairs of opposite main bars. The second end is wound around the reinforcement stirrup and the other main bar of the pair of opposite main bars.

18 Claims, 14 Drawing Sheets

DOUBLE WINDING REINFORCEMENT METHOD AND PRODUCT MADE BY THE SAME

BACKGROUND OF THE INVENTION

1. Field of the Invention

The invention relates to a reinforcement method for reinforcing bars in building construction, especially to a double winding reinforcement method and the product made by the method.

2. Description of Related Art

A reinforcement structure is mainly applied to enclose and fix main bars, thereby avoiding the main bars bending outward. Therefore, the main bars must be positioned accurately at bending corners of two ends of the reinforcement structures. Otherwise, the enclosing and fixing effect of the main bars would be affected, and this would decrease aseismatic strength of a building.

With reference to FIGS. 11 to 14, a conventional single winding reinforcement structure has multiple main bars 70, a reinforcement stirrup 80, and multiple reinforcement bars 90. The multiple main bars 70 are vertically disposed and arranged in a rectangular shape. The reinforcement stirrup 80 is wound around the multiple main bars 70. Each reinforcement bar 90 is horizontally tied with two opposite main bars 70. Each reinforcement bar 90 has a first end 91 and a second end 92. The first end 91 of each reinforcement bar 90 is wound around one of the main bars 70 and bent at an angle of 90 degrees. The second end 92 of each reinforcement bar 90 is wound around one of the main bars 70 at 135 degrees.

However, as for installing the conventional single winding reinforcement structure at a construction site, since each reinforcement bar 90 is bent at a fixed length, the multiple main bars 70 would be displaced as the construction sites differ. With reference to FIG. 12, the displaced main bar 71 is hard to be accurately positioned, such that one end of the reinforcement bar 90 encloses the main bar 70 but the other end of the reinforcement bar 90 cannot completely enclose the main bar 70. Therefore, the column toughness and effective enclosed area (area in dashed line) would be influenced, and the aseismatic strength of the construction site cannot meet the expected effect.

With reference to FIGS. 13 and 14, the reinforcement structure is applied in a laboratory. The main bars 70 can be precisely positioned, the first end 91 of the reinforcement bar 90 is horizontally wound around one of the main bars 70 at 135 degrees. The second end 92 of the reinforcement bar 90 is horizontally wound around the other main bar 70. The effectively enclosed area is larger than that shown in FIG. 11 and FIG. 12, but in the laboratory the reinforcement bar 90 is wound on the main bar 70 from top to down, which is hard to be practiced in a real construction site.

SUMMARY OF THE INVENTION

The main objective of the present invention is to provide a double winding reinforcement method and the product made by the method.

The double winding reinforcement method has a main bars erecting step, a reinforcement stirrup winding step, and a reinforcement bar double ends winding step. In the main bars erecting step, multiple main bars are vertically disposed, and the multiple main bars are arranged in a rectangular shape. In the reinforcement stirrup winding step, a reinforcement stirrup is horizontally wound around the multiple main bars, reinforcement stirrup is wound into a rectangular shape, and the main bars are defined as multiple pairs of opposite main bars. In the reinforcement bar double ends winding step, each reinforcement bar has a first end and a second end. The first end of each reinforcement bar is fixed with one of the main bars of a respective one of the pairs of opposite main bars. The second end of each reinforcement bar is wound around the reinforcement stirrup and the other main bar of said one pair of opposite main bars.

Other objects, advantages, and novel features of the invention will become more apparent from the following detailed description when taken in conjunction with the accompanying drawings.

DETAILED DESCRIPTION OF PREFERRED EMBODIMENT

With reference to FIGS. 1 to 4, a first embodiment of a double winding reinforcement method in accordance with the present invention comprises the following steps: a main bars erecting step S1, a reinforcement stirrup winding step S2, and a reinforcement bar double ends winding step S3.

In the main bars erecting step S1, multiple main bars 10 are vertically disposed, and the multiple main bars 10 are arranged in a rectangular shape. In the reinforcement stirrup winding step S2, a reinforcement stirrup 20 is horizontally wound around the multiple main bars 10, and the reinforcement stirrup 20 is wound in a rectangular shape.

Figure 1:
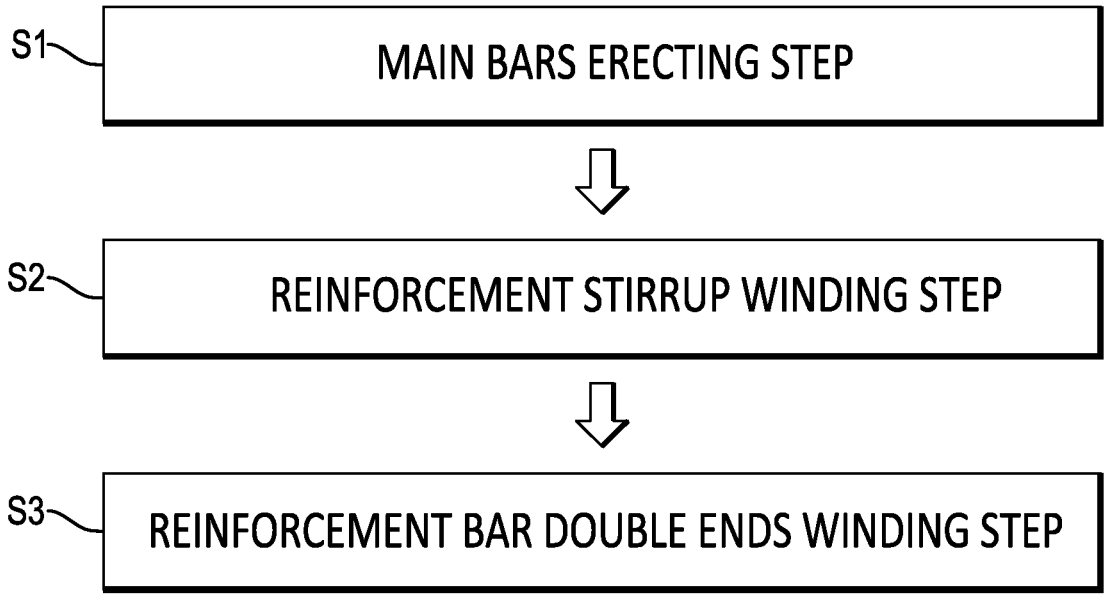
FIG. 1 is a block diagram of a first embodiment of a double winding reinforcement method in accordance with the present invention.
Figure 2:
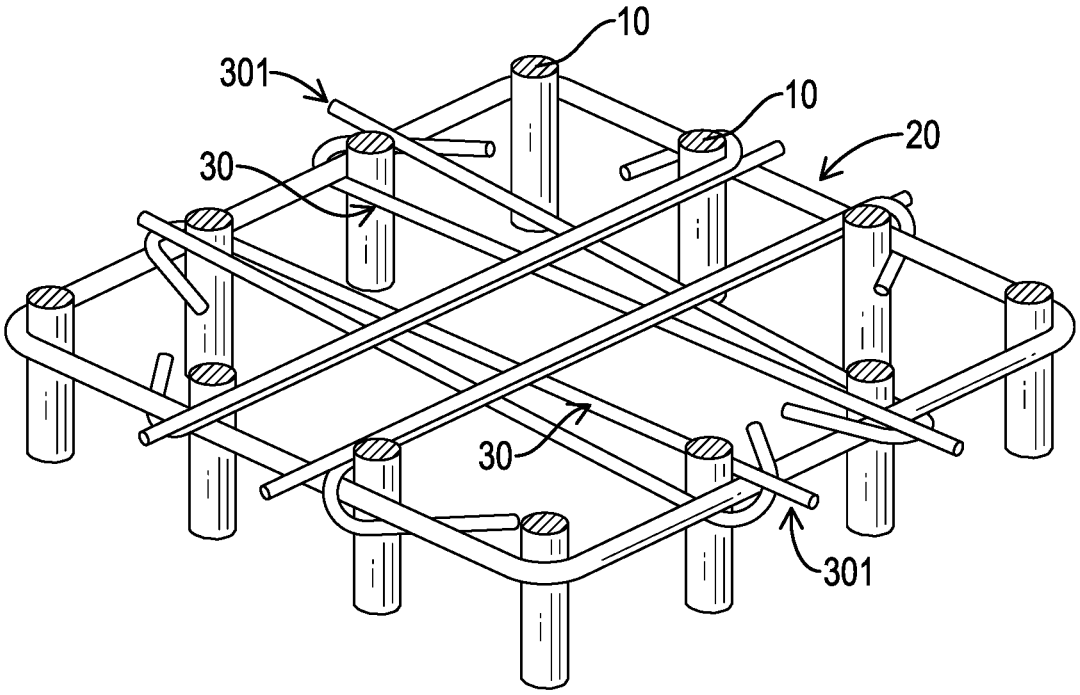
FIG. 2 is a perspective view in partial section of a first embodiment of a double winding reinforcement structure made by the method in FIG. 1.
Figure 3:
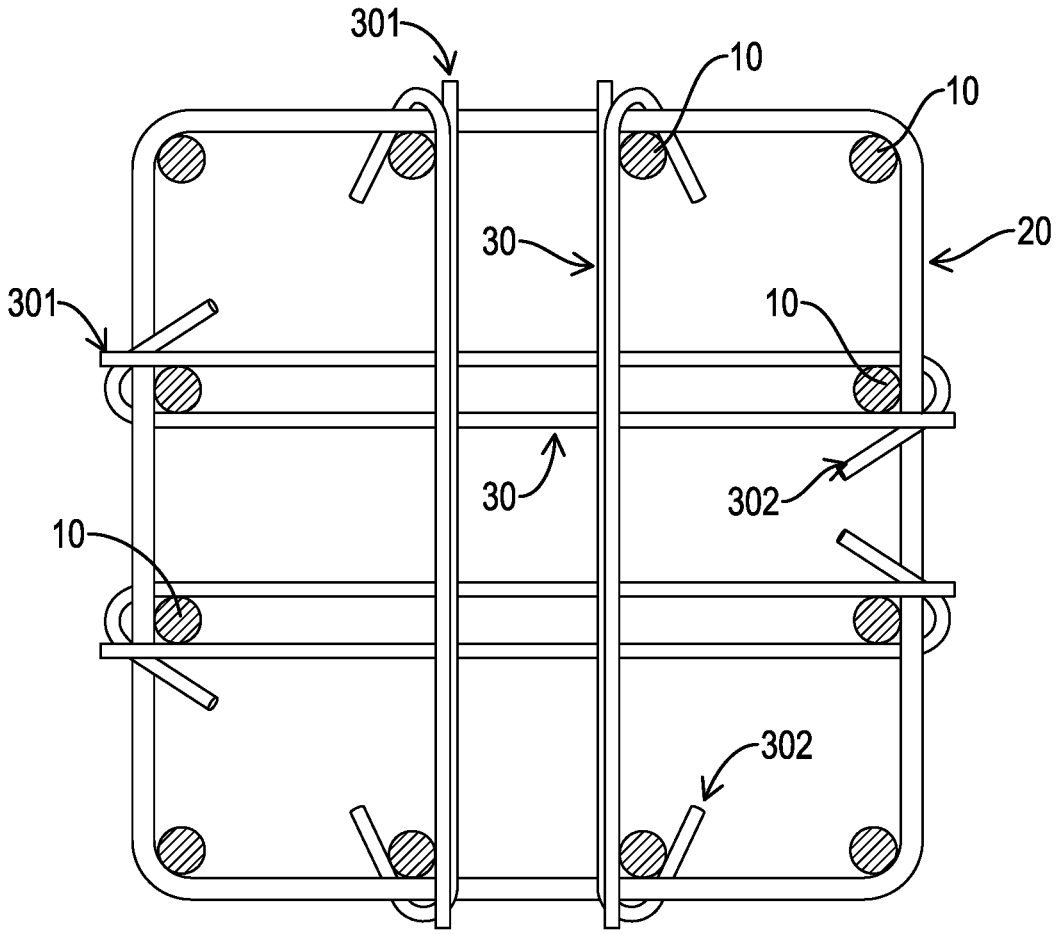
FIG. 3 is a top view of the double winding reinforcement structure in FIG. 2.
Figure 4:
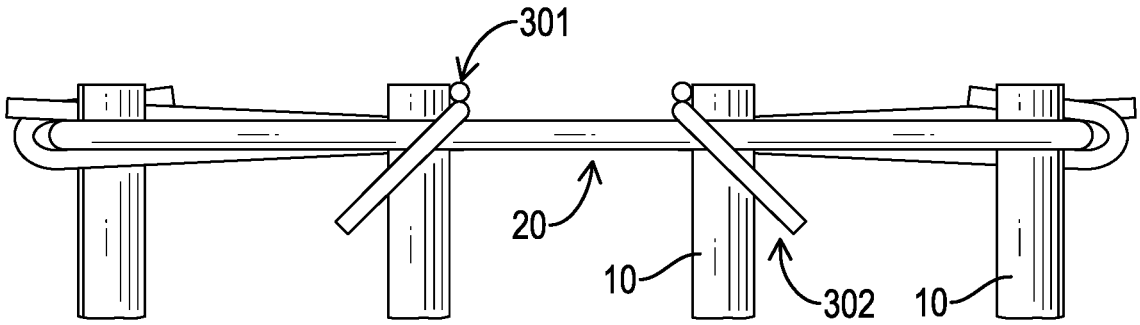
FIG. 4 is a side view of the double winding reinforcement structure in FIG. 2.
Figure 5:
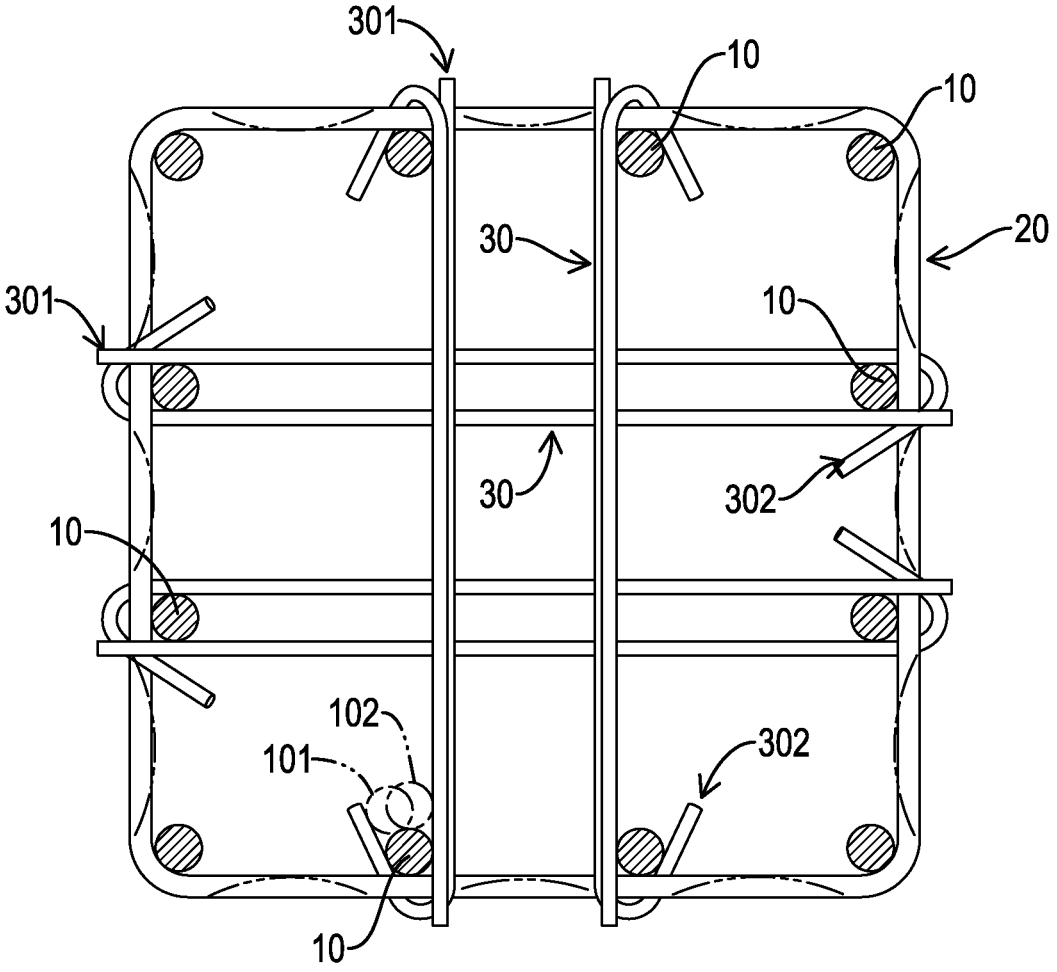
FIG. 5 is a top view of the double winding reinforcement structure in FIG. 1, showing the enclosed area of the reinforcement structure.

In the reinforcement bar double ends winding step S3, multiple reinforcement bars 30 are prepared, and each reinforcement bar 30 is wound around two opposite main bars 10. Each reinforcement bar 30 has a first end 301 and a second end 302. The first end 301 of each reinforcement bar 30 is fixed with one of the opposite main bars 10. The second end 302 of each reinforcement bar 30 is wound around the reinforcement stirrup 20 and the other main bar 10 at 135 degrees. That is, the second end 302 of each reinforcement bar 30 is obliquely wound around the reinforcement stirrup 20 and the other main bar 10. When the first embodiment of the reinforcement method is in use, since the second end 302 of each reinforcement bar 30 is wound around the reinforcement stirrup 20 and the other main bar 10 at 135 degrees, each reinforcement bar 30 is wound around the main bar 10 and the reinforcement stirrup 20 at the same time. Therefore, the binding strength of each reinforcement bar 30 is enhanced. With reference to FIG. 5, the enclosed area of the first embodiment is increased. The main bars 101, 102 can be still confined in the enclosed area (dashed line area) even when the main bars 101, 102 are displaced. The column's axial force and toughness are effectively improved to improve the earthquake resistance of the building.

Figure 6:
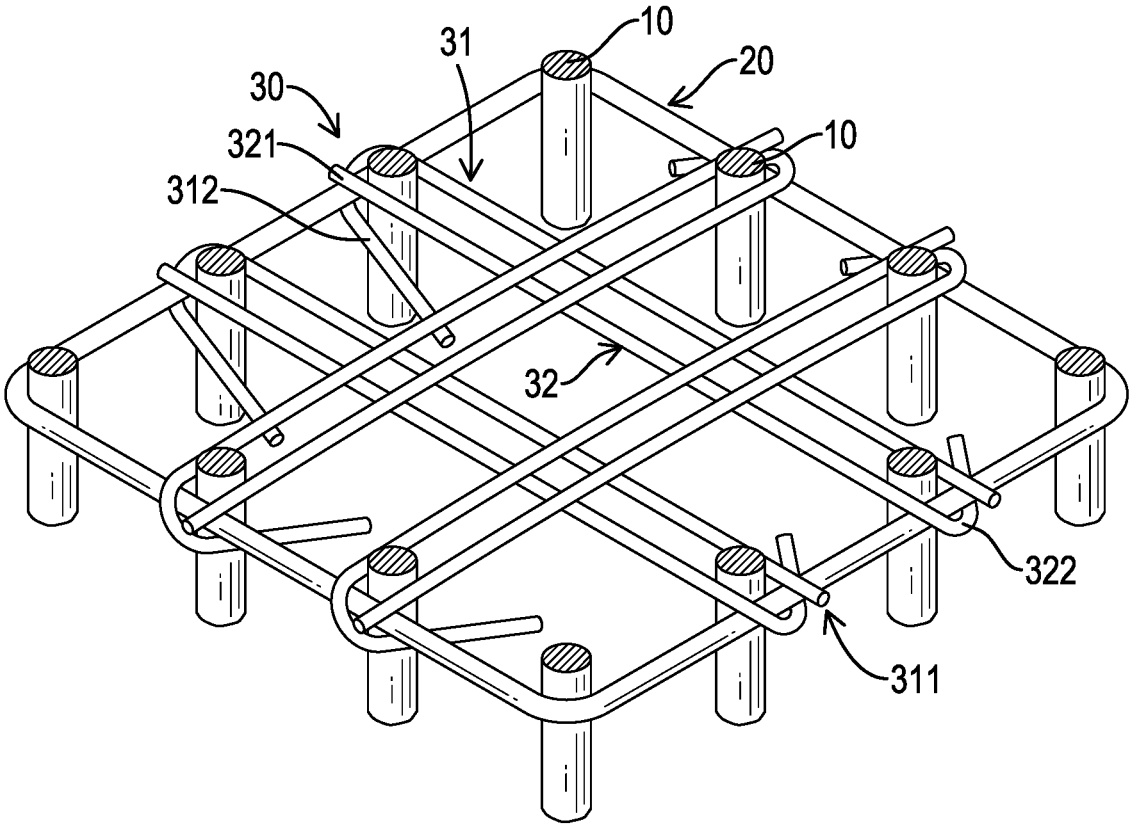
FIG. 6 is a perspective view in partial section of a second embodiment of a double winding reinforcement structure made by the method in FIG. 1.
Figure 7:
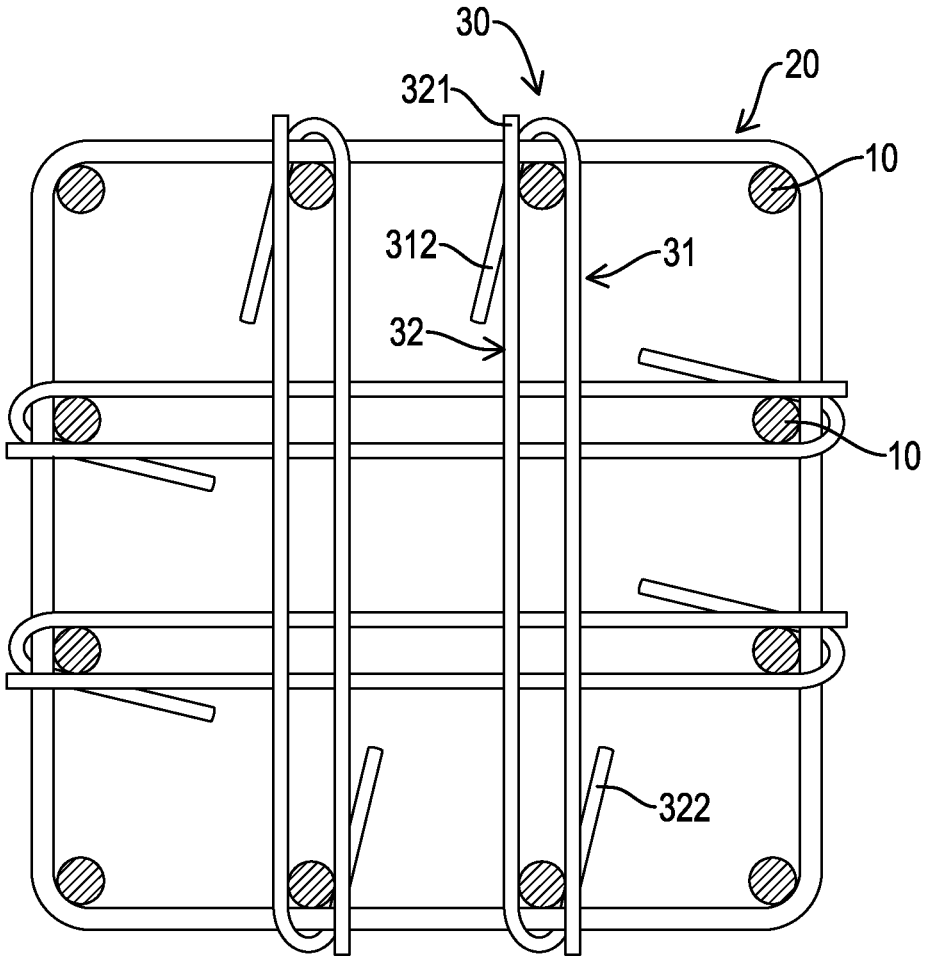
FIG. 7 is a top view of the double winding reinforcement structure in FIG. 6.

With reference to FIGS. 6 and 7, a second embodiment of a double winding reinforcement method in accordance with the present invention is substantially the same as the first embodiment except for the following features. In the reinforcement bar double ends winding step S3, two reinforcement bars 30 are disposed at two sides of two opposite main bars 10. The two reinforcement bars 30 are defined as a first reinforcement bar 31 and a second reinforcement bar 32. The first reinforcement bar 31 has a first end 311 and a second end 312. The second reinforcement bar 32 has a first end 321 and a second end 322. The first end 311 of the first reinforcement bar 31 is fixed with the main bar 10. The second end 312 of the first reinforcement bar 31 is wound around the main bar 10 and the reinforcement stirrup 20 at 135 degrees. The first end 321 of the second reinforcement bar 32 is fixed with the main bar 10. The second end 322 of the second reinforcement bar 32 is wound around the other main bar 10 and the reinforcement stirrup 20 at 135 degrees. Furthermore, the second end 312 of the first reinforcement bar 31 is wound around the first end 321 of the second reinforcement bar 32 and the reinforcement stirrup 20 from top to bottom. The second end 322 of the second reinforcement bar 32 is wound around the first end 311 of the first reinforcement bar 31 and the reinforcement stirrup 20 from top to bottom.

When the second embodiment of the reinforcement method is in use, the two reinforcement bars 30 are disposed at the two sides of each main bar 10, the second end 312 of the first reinforcement bar 31 is wound around the main bar 10 and the reinforcement stirrup 20 at 135 degrees, and the second end 322 of the second reinforcement bar 32 is wound around the other main bar 10 and the reinforcement stirrup 20 at 135 degrees. The structural strength of the main bars 10 is enhanced, and the aseismatic strength of the main bars 10 is enhanced.

Figure 8:
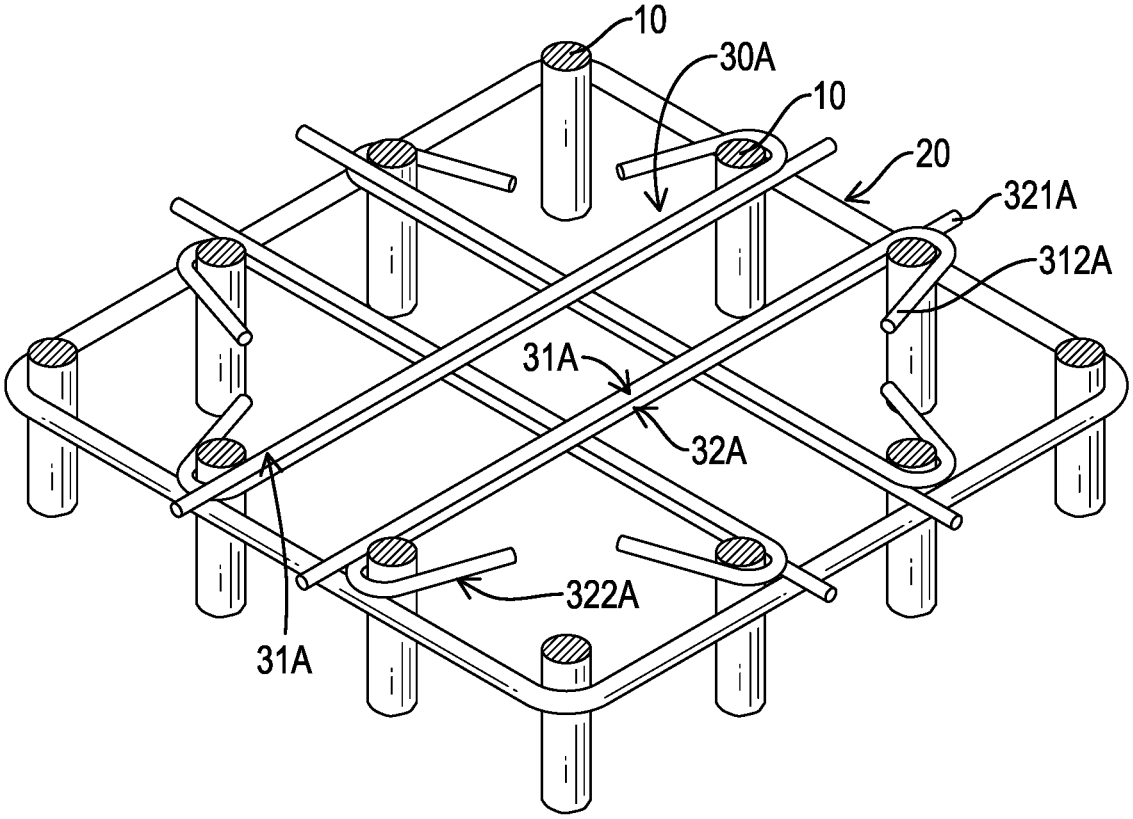
FIG. 8 is a perspective view of a third embodiment of a double winding reinforcement structure made by the method in FIG. 1.
Figure 9:
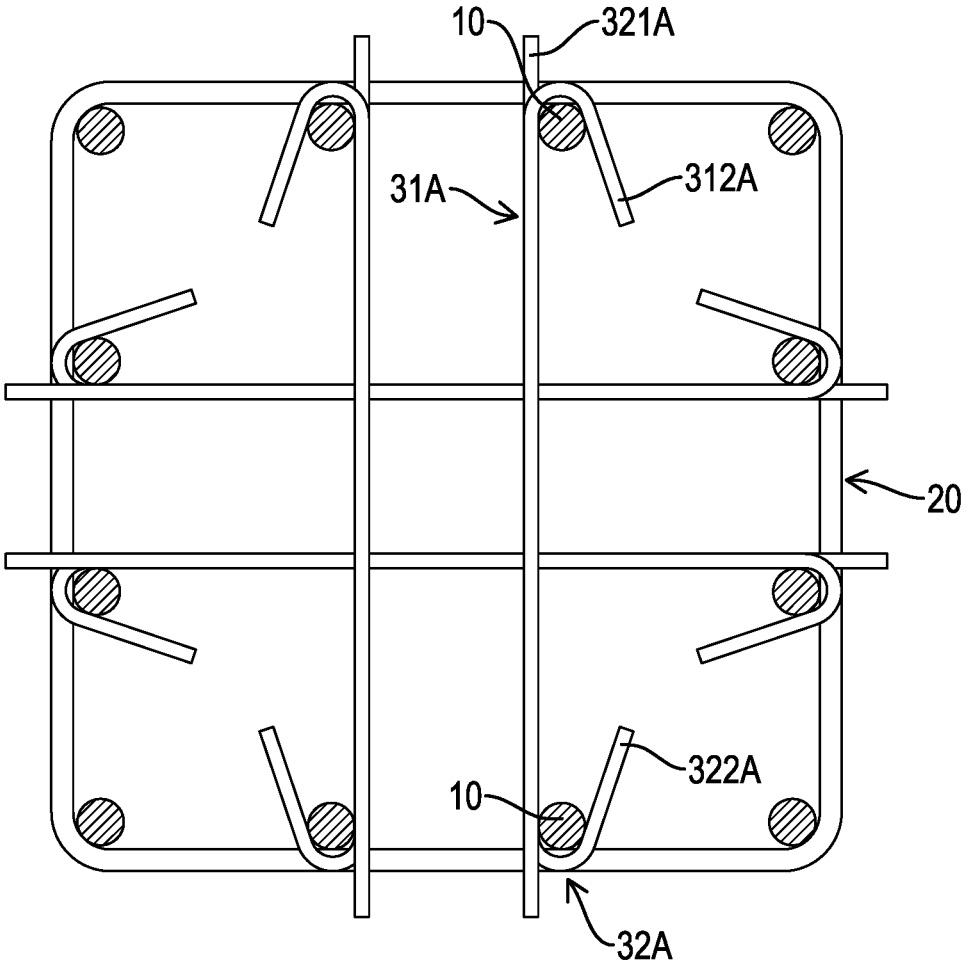
FIG. 9 is a top view of the double winding reinforcement structure in FIG. 8.

With reference to FIGS. 8 and 9, a third embodiment of a double winding reinforcement method in accordance with the present invention is substantially the same as the first embodiment except for the following features. In the reinforcement bar double ends winding step S3, two reinforcement bars 30A are disposed at one side of two opposite main bars 10. The two reinforcement bars 30A are defined as a first reinforcement bar 31A and a second reinforcement bar 32A. The first reinforcement bar 31A has a first end 311A and a second end 312A. The second reinforcement bar 32A has a first end 321A and a second end 322A. The first end 311A of the first reinforcement bar 31A is fixed with the main bar 10. The second end 312A of the first reinforcement bar 31A is wound around the other main bar 10 and the reinforcement stirrup 20 at 135 degrees. The first end 321A of the second reinforcement bar 32A is fixed with the main bar 10. The second end 322A of the second reinforcement bar 32A is wound around the other main bar 10 and the reinforcement stirrup 20 at 135 degrees. Furthermore, the first reinforcement bar 31A is above the second reinforcement bar 32A. The second end 312A of the first reinforcement bar 31A is obliquely wound around the first end 321A of the second reinforcement bar 32A and the reinforcement stirrup 20.

When the third embodiment of the reinforcement method is in use, the two reinforcement bars 30A are disposed at the same side of the two opposite main bars 10, the second end 312A of the first reinforcement bar 31A is wound around the other main bar 10 and the reinforcement stirrup 20 at 135 degrees, and the second end 322A of the second reinforcement bar 32A is wound around the other main bar 10 and the reinforcement stirrup 20 at 135 degrees. Therefore, the structural strength of the main bars 10 is enhanced, and the aseismatic strength of the main bars 10 is enhanced.

Figure 10:
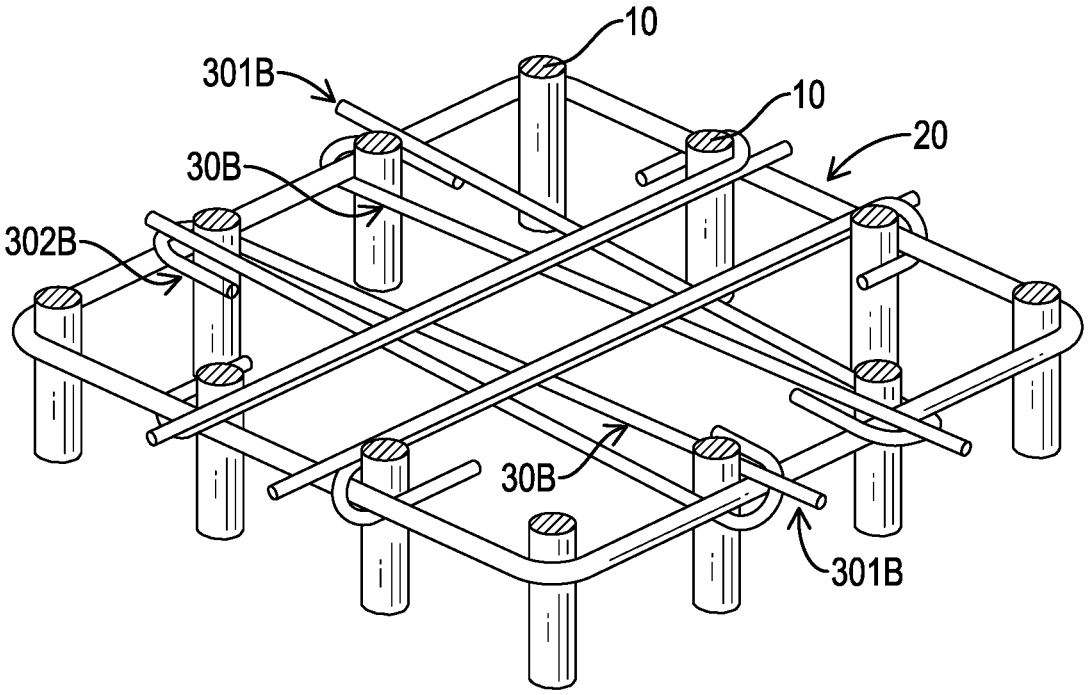
FIG. 10 is a perspective view of a fourth embodiment of a double winding reinforcement structure made by the method in FIG. 1.
Figure 11:
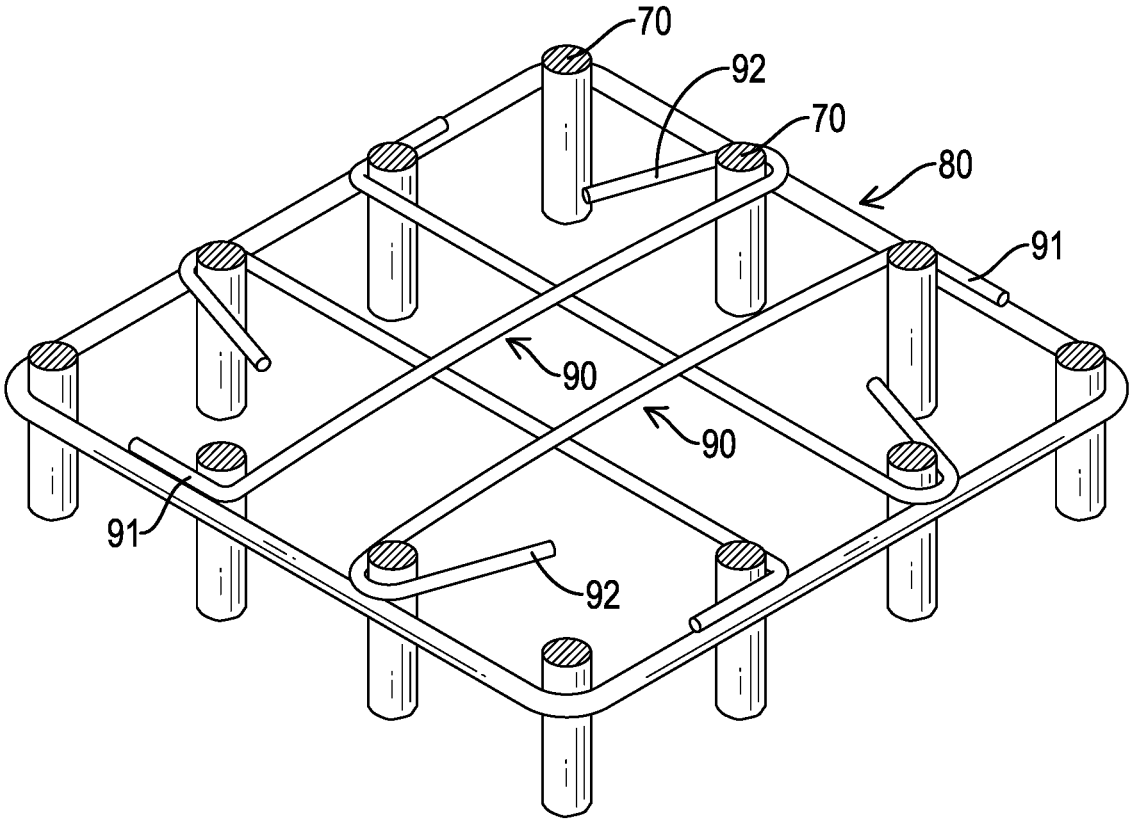
FIG.11 PRIOR ART
FIG. 11 is a perspective view of a conventional single winding reinforcement structure.
Figure 12:
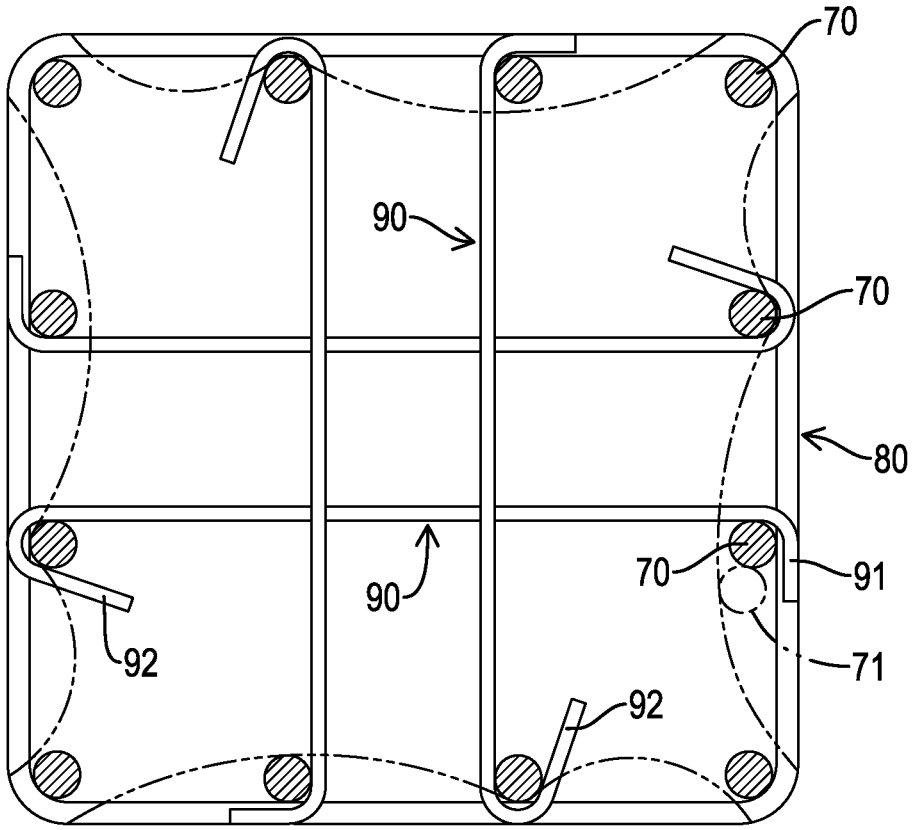
FIG.12 PRIOR ART
FIG. 12 is a top view of the conventional single winding reinforcement structure in FIG. 11 showing the enclosed area of the conventional single winding reinforcement structure.
Figure 13:
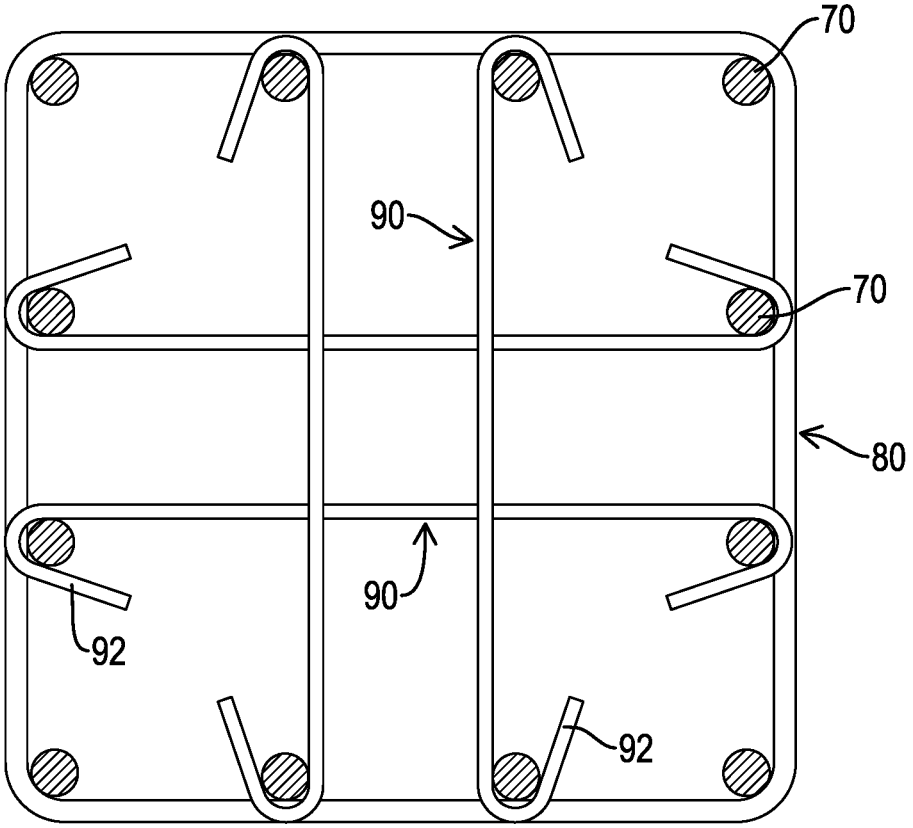
FIG.13 PRIOR ART
FIG. 13 is a perspective view of another conventional single winding reinforcement structure.
Figure 14:
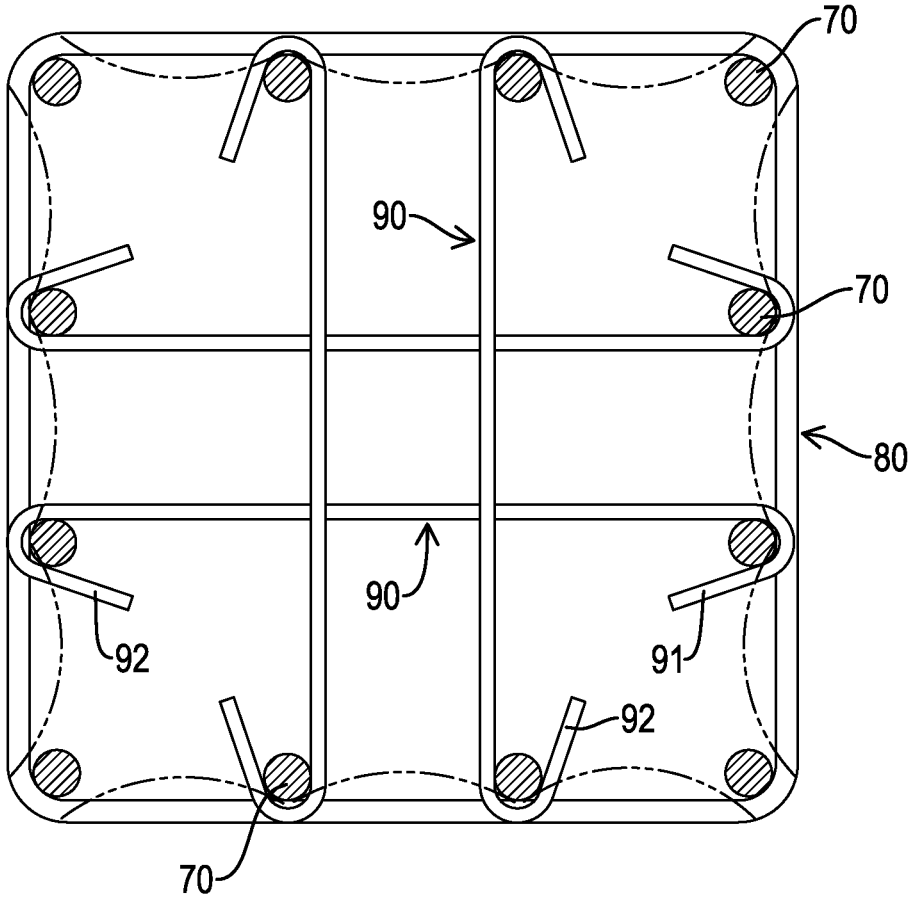
FIG.14 PRIOR ART
FIG. 14 is a top view of the conventional single winding reinforcement structure in FIG. 13 showing the enclosed area of the conventional single winding reinforcement structure.

With reference to FIG. 10, a fourth embodiment of a double winding reinforcement method in accordance with the present invention is substantially the same as the first embodiment except for the following features. In the reinforcement bar double ends winding step S3, a second end 302B of each reinforcement bar 30B is wound around the other main bar 10 and the reinforcement stirrup 20 at 180 degrees. That is, the second end 302B of each reinforcement bar 30B is obliquely wound around the other main bar 10 and the reinforcement stirrup 20. The operational way of the fourth embodiment is the same as that of the first embodiment and the detailed description thereof is omitted.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A double winding reinforcement method comprising steps of:

a main bars erecting step, wherein multiple main bars are vertically disposed, and the multiple main bars are arranged in a rectangular shape;

a reinforcement stirrup winding step, wherein a reinforcement stirrup is horizontally wound around the multiple main bars, the reinforcement stirrup is wound in a rectangular shape, and the main bars are defined as multiple pairs of opposite main bars; and a reinforcement bar double ends winding step, wherein multiple reinforcement bars are prepared, each one of the pairs of opposite main bars is wound around by two of the reinforcement bars, each reinforcement bar has a first end and a second end, the first end of each reinforcement bar is fixed with one of the main bars of the pair of opposite main bars, and the second end of each reinforcement bar is bent and wound around the reinforcement stirrup and the other main bar of the pair of opposite main bars; and the first end of each one of two of the reinforcement bars that are mounted around a same pair of opposite main bars is adjacent to the second end of the other one of the two of the reinforcement bars.

2. The double winding reinforcement method as claimed in claim 1, wherein in the reinforcement bar double ends winding step, each pair of opposite main bars has respective two of the reinforcement bars disposed at two sides of the pair of opposite main bars, the two reinforcement bars are defined as a first reinforcement bar and a second reinforcement bar, a first end of the first reinforcement bar is fixed with one of the main bars of the pair of opposite main bars, a second end of the first reinforcement bar is wound around the other main bar of the pair of opposite main bars and the reinforcement stirrup, a first end of the second reinforcement bar is fixed with one of the main bars of the pair of opposite main bars, a second end of the second reinforcement bar is wound around the other main bar of the pair of opposite main bars and the reinforcement stirrup, the second end of the first reinforcement bar is wound around the first end of the second reinforcement bar and the reinforcement stirrup, and the second end of the second reinforcement bar is obliquely wound around the first end of the first reinforcement bar and the reinforcement stirrup.

3. The double winding reinforcement method as claimed in claim 1, wherein in the reinforcement bar double ends winding step, each pair of opposite main bars has respective two of the reinforcement bars disposed at one side of the pair of opposite main bars, the two reinforcement bars are defined as a first reinforcement bar and a second reinforcement bar, a first end of the first reinforcement bar is fixed with one of the main bars of the pair of opposite main bars, a second end of the first reinforcement bar is wound around the other main bar of the pair of opposite main bars and the reinforcement stirrup, a first end of the second reinforcement bar is fixed with one of the main bars of the pair of opposite main bars, a second end of the second reinforcement bar is wound around the other main bar of the pair of opposite main bars and the reinforcement stirrup, the second end of the first reinforcement bar is wound around the first end of the second reinforcement bar and the reinforcement stirrup, the first reinforcement bar is above the second reinforcement bar, and the second end of the first reinforcement bar is obliquely wound around the first end of the second reinforcement bar and the reinforcement stirrup.

4. A double winding reinforcement structure comprising:

multiple pairs of opposite main bars;

a reinforcement stirrup wound around the multiple main bars; and multiple reinforcement bars, each reinforcement bar having a first end fixed with one of the main bars of a respective one of the pairs of opposite main bars; and a second end wound around the other main bar of the respective pair of opposite main bars and the reinforcement stirrup, wherein each one of the pairs of opposite main bars is wound around by two of the reinforcement bars; and the first end of each one of two of the reinforcement bars that are mounted around a same pair of opposite main bars is adjacent to the second end of the other one of the two of the reinforcement bars.

5. The double winding reinforcement structure as claimed in claim 4, wherein each pair of opposite main bars has respective two of the reinforcement bars disposed at two sides of the two opposite main bars, the two reinforcement bars are defined as a first reinforcement bar and a second reinforcement bar, a first end of the first reinforcement bar is fixed with one of the main bars of the pair of opposite main bars, a second end of the first reinforcement bar is wound around the main bar and the reinforcement stirrup, a first end of the second reinforcement bar is fixed with the main bar, and a second end of the second reinforcement bar is wound around the main bar and the reinforcement stirrup.

6. The double winding reinforcement structure as claimed in claim 5, wherein the second end of the first reinforcement bar is wound around the first end of the second reinforcement bar and the reinforcement stirrup, and the second end of the second reinforcement bar is wound around the first end of the first reinforcement bar and the reinforcement stirrup.

7. The double winding reinforcement structure as claimed in claim 4, wherein each pair of opposite main bars has respective two of the reinforcement bars disposed at one side of the pair of opposite main bars, the two reinforcement bars are defined as a first reinforcement bar and a second reinforcement bar, a first end of the first reinforcement bar is fixed with one of the main bars of the pair of opposite main bars, a second end of the first reinforcement bar is wound around the other of the main bars of the pair of opposite main bars and the reinforcement stirrup, a first end of the second reinforcement bar is fixed with one of the main bars of the pair of opposite main bars, and a second end of the second reinforcement bar is wound around the other main bar of the pair of opposite main bars and the reinforcement stirrup.

8. The double winding reinforcement structure as claimed in claim 7, wherein the first reinforcement bar is above the second reinforcement bar, and the second end of the first reinforcement bar is wound around the first end of the second reinforcement bar and the reinforcement stirrup.

9. The double winding reinforcement structure as claimed in claim 4, wherein the second end of each reinforcement bar is wound around one of the main bars of a respective one of the pairs of opposite main bars and the reinforcement stirrup at 135 degrees.

10. The double winding reinforcement structure as claimed in claim 5, wherein the second end of each reinforcement bar is wound around one of the main bars of a respective one of the pairs of opposite main bars and the reinforcement stirrup at 135 degrees.

11. The double winding reinforcement structure as claimed in claim 6, wherein the second end of each reinforcement bar is wound around one of the main bars of a respective one of the pairs of opposite main bars and the reinforcement stirrup at 135 degrees.

12. The double winding reinforcement structure as claimed in claim 7, wherein the second end of each reinforcement bar is wound around one of the main bars of a respective one of the pairs of opposite main bars and the reinforcement stirrup at 135 degrees.

13. The double winding reinforcement structure as claimed in claim 8, wherein the second end of each reinforcement bar is wound around one of the main bars of a respective one of the pairs of opposite main bars and the reinforcement stirrup at 135 degrees.

14. The double winding reinforcement structure as claimed in claim 4, wherein the second end of each reinforcement bar is wound around one of the main bars of a respective one of the pairs of opposite main bars and the reinforcement stirrup at 180 degrees.

15. The double winding reinforcement structure as claimed in claim 5, wherein the second end of each reinforcement bar is wound around one of the main bars of a respective one of the pairs of opposite main bars and the reinforcement stirrup at 180 degrees.

16. The double winding reinforcement structure as claimed in claim 6, wherein the second end of each reinforcement bar is wound around one of the main bars of a respective one of the pairs of opposite main bars and the reinforcement stirrup at 180 degrees.

17. The double winding reinforcement structure as claimed in claim 7, wherein the second end of each reinforcement bar is wound around one of the main bars of a respective one of the pairs of opposite main bars and the reinforcement stirrup at 180 degrees.

18. The double winding reinforcement structure as claimed in claim 8, wherein the second end of each reinforcement bar is wound around one of the main bars of a respective one of the pairs of opposite main bars and the reinforcement stirrup at 180 degrees.

* * * * *